US006749031B2

(12) United States Patent
Klemm

(10) Patent No.: US 6,749,031 B2
(45) Date of Patent: Jun. 15, 2004

(54) DRILLING SYSTEM

(76) Inventor: Gunter W. Klemm, Gray 21, A-9572 Deutsch-Griffen (AT)

( * ) Notice: Subject to any disclaimer, the term of this patent is extended or adjusted under 35 U.S.C. 154(b) by 75 days.

(21) Appl. No.: 09/983,009

(22) Filed: Oct. 17, 2001

(65) Prior Publication Data

US 2002/0070049 A1 Jun. 13, 2002

(30) Foreign Application Priority Data

Dec. 6, 2000 (EP) ..... 00126781
Mar. 12, 2001 (EP) ..... 01201167

(51) Int. Cl.[7] ..... E21B 7/08; E21B 7/26

(52) U.S. Cl. ..... 175/73; 175/293; 175/61; 175/19

(58) Field of Search ..... 175/296, 61, 73, 175/75, 293, 19, 414, 415

(56) References Cited

U.S. PATENT DOCUMENTS

| | | | | | |
|---|---|---|---|---|---|
| 2,018,007 | A | * | 10/1935 | Brewster | 175/75 |
| 2,315,629 | A | * | 4/1943 | Le Bus | 175/267 |
| 2,684,581 | A | | 7/1954 | Zublin | |
| 3,797,586 | A | * | 3/1974 | Coyne et al. | 173/133 |
| 4,362,520 | A | * | 12/1982 | Perry | 464/149 |
| 4,368,786 | A | | 1/1983 | Cousins | |
| 4,442,908 | A | * | 4/1984 | Steenbock | 175/74 |
| 4,476,945 | A | * | 10/1984 | Hearn | 175/203 |
| 4,732,223 | A | * | 3/1988 | Schoeffler et al. | 175/73 |
| 4,787,463 | A | * | 11/1988 | Geller et al. | 175/45 |
| 4,880,067 | A | * | 11/1989 | Jelsma | 175/107 |
| 5,007,487 | A | | 4/1991 | Dahle et al. | |
| 5,078,218 | A | * | 1/1992 | Smet | 175/45 |
| 5,265,687 | A | * | 11/1993 | Gray | 175/62 |
| 5,467,834 | A | * | 11/1995 | Hughes et al. | 175/61 |
| 5,538,092 | A | * | 7/1996 | Precopia | 175/74 |
| 5,542,482 | A | * | 8/1996 | Eddison | 175/61 |
| 5,547,031 | A | * | 8/1996 | Warren et al. | 175/61 |
| 5,937,954 | A | * | 8/1999 | Puttmann et al. | 175/61 |
| 6,012,536 | A | * | 1/2000 | Puttmann et al. | 175/21 |
| 6,527,067 | B1 | * | 3/2003 | Ravensbergen et al. | 175/381 |

FOREIGN PATENT DOCUMENTS

| | | |
|---|---|---|
| DE | 4211081 C1 | 9/1993 |
| DE | 4225701 C1 | 12/1993 |
| DE | 4328278 A1 | 3/1994 |
| DE | 19612902 A1 | 10/1997 |
| EP | 0 387 218 B1 | 2/1990 |

OTHER PUBLICATIONS

International Search Report, Application No. EP 01 20 1167, mailed Jun. 11, 2001.

* cited by examiner

*Primary Examiner*—David Bagnell
*Assistant Examiner*—Shane Bomar
(74) *Attorney, Agent, or Firm*—Meyertons Hood Kivlin Kowert & Goetzel, P.C.; Jeffrey C. Hood

(57) ABSTRACT

The invention concerns a drilling system having a drilling head (2, 2') fixed to a drill string (3) which comprises an outer pipe (12, 12') and a percussion string (13, 13') inserted therein, wherein the percussion string (13, 13') comprises a plurality of rods (14, 14') which bear against each other with their end faces (19, 20; 19', 20'). One object of the present invention is to provide a drilling system with an inner percussion string, which permits a greater variation in the drilling direction and which can be used as a directional drilling system. To attain that object the outer pipe (12) is adapted to be deformable along its longitudinal axis and the end faces (19, 20) which bear against each other of two rods (14) are so designed that they bear against each other substantially in surface contact upon inclined positioning of the axes of the two rods (14) relative to each other.

26 Claims, 8 Drawing Sheets

23
18
46
45
44
25
26'
22
17'
12'
14'
13'
20'
19'
43
42
34'
32'
2
48
49
43'
42'

27
50
51
52
13'
12'
37
39
38
32'
50
51
55
53
53
54
56
53
53
53
53
55
55
53
55
53

DRILLING SYSTEM

FIELD OF THE INVENTION

The invention concerns a drilling system having a drilling head fixed to a drill string which comprises an outer pipe and a percussion string inserted therein, wherein the percussion string comprises a plurality of rods which bear against each other with their end faces.

DESCRIPTION OF THE RELATED ART

A drilling system of that kind is known from EP 0 387 218 B1. This involves a rock drilling arrangement for producing straight boreholes for receiving anchors for buildings or explosive charges for carrying out rock blasting operations. In that case the cylindrical shank of the drilling bit is mounted axially displaceably to the front end of the outer pipe by way of a cylindrical guide which is several centimetres long and which is in contact with a small clearance. The same applies in regard to the free end of the rear drill rod against which a hammer or percussion piston strikes to apply the percussion forces. Each individual rod is guided in the region of two bushes at two positions on its length. Provided in the region of the guides for the percussion rod are axially extending ducts for passing therethrough a flushing medium, which make it possible for a flushing medium to be conveyed towards the drilling head from the rear end of the drill string through the intermediate space between the outer pipe and the percussion string or through the axially extending ducts between the outer pipe and the percussion string. The end faces of the individual rods of the percussion string, which bear against each other, extend in the radial direction so as to afford a maximum effective surface area for transmission of the axially acting percussion forces.

The arrangement described in EP 0 387 218 B1 has some major advantages which are essentially that the inner percussion string comprises various individual rods which bear against each other without screwing. The individual short rod has a natural frequency which is very much higher than a long screwed percussion string. Thus, in terms of transmission of the percussion force, very much harder and undamped transmission of the percussion force is afforded by way of a plurality of short rods which bear against each other without a screw connection. Added to that is greater ease of handling during the drilling operation. After the drilling arrangement is advanced by the length of an outer pipe section or an inner rod, the rotary and percussion drive is separated from the drill string and a fresh inner rod and a fresh outer pipe is introduced into the drill string. That situation involves time savings by virtue of the fact that the inner rod to be inserted does not have to be screwed in place.

The arrangement known from the above-quoted document is however suitable by virtue of its structure only for making bores which extend precisely in the axial direction of the drill string.

The object of the present invention is to provide a drilling system which permits a greater variation in the drilling direction.

In accordance with the invention that object is attained in that the outer pipe is adapted to be deformable along its longitudinal axis and the end faces of two rods which bear against each other are such that they bear against each other substantially in surface contact upon inclined positioning of the axes of the two rods relative to each other.

Drilling systems with elastically bendable outer pipes—so-called directional drilling systems—are known from the state of the art, for example from DE 196 12 902 A1. That publication states that a drill string having a drilling head which produces a curved borehole configuration is used for directional drilling. In straight-line drilling the drilling head is rotated at a uniform, generally low angular speed so that the force deflecting the drilling head is uniformly distributed to the entire periphery of the drilling head and is thus cancelled out. For drilling a radius, the drilling head remains in a given angular position without drilling drive so that it follows the curved path which is predetermined by virtue of its structural features. In that case the drilling heads may be of very different configurations. The drill string is usually mounted on a rail-guided sliding carriage connected to a linear drive and has a rotary or rotary-percussion drive with which the string can be caused to rotate and possibly also driven into the ground. In the previously known directional drilling systems the outer string was in principle used for transmission of the percussion force. Besides the above-described problem that the long outer string has a low natural frequency and is of a high mass, that gave rise to an additional problem that the wall friction of the outer string which is guided in the curvedly extending borehole in the earth nullifies a considerable proportion of the percussion energy. Furthermore, in addition to the mass of the outer pipe, the mass of the flushing medium contained in the outer pipe also has to be accelerated by the percussion drive. Finally, a hammer blow on the rear end of a curved pipe produces not only axial acceleration but also a bending force. In practice it has been found that the percussion force acting on the rear end of the drill string scarcely arrives in the region of the drilling head.

The inner string which can be found for example in FIGS. 6 and 7 of DE 196 12 902 A1 could not be used for percussion force transmission purposes. Either it was proposed that the individual elements of the inner string are connected together by way of universal joints which are destroyed by ongoing percussion forces. Alternatively, it was proposed that the universal joints be omitted, if the inner string is sufficiently flexible. With a high degree of flexibility however, it is not possible to achieve a sufficiently great percussion force transmission effect.

SUMMARY OF THE INVENTION

The proposal in accordance with the present invention, to provide a drilling system with rods which bear against each other in unscrewed relationship as a directional drilling system with a flexible outer pipe permits the transmission of percussion force by way of the inner percussion string if the end faces of two rods, which bear against each other, are so designed that they bear against each other substantially in surface contact even upon inclined positioning of the axes of the two rods. In other words, based on the drilling system described in the opening part of this specification and disclosed in EP 0 387 218 B1, end faces which depart from the flat radial shape had to be proposed, so as to ensure effective transmission of percussion forces even in a situation involving bending of the outer pipe which results in inclined positioning of the longitudinal axes of two drill rods relative to each other.

In comparison with the previously known transmission of percussion forces in directional drilling systems by way of the outer pipe, percussion force transmission by way of an inner percussion string has the crucial advantage that the percussion force cannot be reduced by virtue of friction of the percussion string against the wall of the borehole. As a general rule a flushing medium is passed between the outer pipe and the inner string, the flushing medium comprising for example water with swellable clay (bentonite). The aqueous swellable clay is of a viscous to pasty consistency and produces relatively slight frictional resistances upon movement of the percussion string with respect to the outer pipe. In that respect the flushing medium itself is not accelerated by the hammer blows and cannot absorb any percussion energy.

The hammer blows are transmitted by short straight rod sections of the inner string, in which respect no bending forces can occur as the individual rods of the inner string are not curved.

An essential feature of the invention provides that, in the case of the inner percussion string of the directional drilling system according to the invention, no fixed connection exists between the ends of the individual rods of the percussion string. In particular, screwing of the rod ends was eliminated. A screwed percussion string is unsuitable precisely in relation to directional drilling in which—unlike the situation with straight drilling operations—often only a slow rotary drive for the drilling head is involved or the drilling head remains completely in a specific angular position for a relatively long period of time. If a permanent hydraulic percussion drive acts on a screwed string, the screw connections generally loosen due to the hammer blows. It is only if the string is constantly driven in the fastening direction of the screw means by a rotary drive that it is ensured that the screw connections do not come apart, in spite of the hammer blows on the string. In the case of a directional drilling arrangement in which the rotary drive often has to be stopped for a relatively long period of time, there is the risk that the screw connections of the individual rods of the percussion drive come loose because of the hammer blows, and that results in destruction of the percussion string upon further forward drive movement of the drilling system.

That risk does not occur in the drilling system according to the invention which eliminates fixed connections between the rod ends and in particular screw connections between the rod ends.

As the outer pipe is adapted to be deformable along its longitudinal axis, that is to say the longitudinal axis is bendable in a radius about a centre of a circle, care should be taken to ensure that each rod is supported against the inner wall of the outer pipe only in one or two short regions of the length of the rod. In that respect, the preferred structure is one in which each rod is supported against the outer pipe only in a single annular region of the rod periphery and in the other regions of its length it is of an outside diameter which is one or more centimetres smaller than the inside diameter of the outer pipe. In the region of a bend in the outer pipe the inner percussion string can extend from one support location to another in various straight sections.

Care should still be taken to ensure that flushing medium can pass unimpededly through the annular space between the outer pipe and the percussion string. For that reason, in the region in which each rod of the percussion string is guided against the inner wall of the outer pipe, there should be provided a recess which extends in the axial direction or a duct which extends in the axial direction, so that the flushing medium can still pass therethrough. For example, grooves which extend in the longitudinal direction and through which the flushing medium flows can be provided in the wide regions of the rod, which bear against the inner wall of the outer pipe. Alternatively, the outer pipe can be provided over its entire length with axial grooves for the flushing liquid to be passed therethrough. That means however that it is necessary to reckon on an increase in the manufacturing costs for the outer pipe.

In a particularly preferred embodiment of the invention the end faces, which bear against each other, of two rods of the percussion string are curved on the one hand convexly and on the other hand concavely. Preferably each rod of the percussion string has a first end with a ball head and a second end with a ball socket, wherein the radii of curvature of the ball surfaces of the ball head and the ball socket substantially correspond to each other. The percussion rod of the percussion drive, on which the percussion piston of the percussion drive acts, should then have a surface which is complementary to the end face of the rearmost rod of the percussion string. Likewise the shank of the drilling bit with the drilling head has an end face which is complementary to the foremost end face of the foremost rod of the percussion string.

When the end of the percussion rod is in the form of a ball head, the ball head preferably forms the region for radial support of the rod against the inner wall of the outer pipe. The section of the rod, which extends from the ball head and which is in the form of a cylindrical rod, is of a smaller diameter than the ball head. To form the axially extending flow ducts for the flushing medium, the ball head has axially extending recesses which are arranged in the region of its equator, with respect to the longitudinal axis of the rod.

As mentioned in the opening part of this specification, a rotary force is transmitted to the drilling head in order either to rotate it continuously or to move it into a given angular position when a radius is to be drilled. In the case of directional drilling systems in accordance with the state of the art, in which percussion forces which are possibly produced are transmitted by way of the outer pipe, the drilling head is simply rigidly connected to the outer pipe. In the present case in which percussion forces are transmitted to a drilling bit, the drilling bit can be held non-rotatably in the outer pipe, in which case it should be movable axially by a certain distance. The axially movable support for the drilling bit ensures that the percussion energy acting on the drilling bit is not applied to the outer pipe. The drilling bit is displaceable with respect to the outer pipe so that the percussion energy is transmitted directly on to the bottom of the borehole by way of the drilling head.

The non-rotatable fitment of the drilling bit in the outer pipe can be achieved for example by a positively locking connection between the shank of the drilling bit and the outer pipe. The shank of the drilling bit can be provided with an external spline or tooth configuration which engages into an internal spline or tooth configuration of the outer pipe. The rotary drive is then connected to the rear end of the outer pipe and is preferably hydraulically actuated to achieve the required torque levels.

Alternatively the torques can be transmitted to the drilling head by way of the percussion string if the ends of two rods which bear against each other have connecting elements which engage into each other in positively locking relationship. For example, one of the ends, in particular the end in the form of a ball socket, can be provided with a recess into which projects a projection at the other end, in particular the end in the form of the ball head. The ball socket, in the region of the outer periphery of the ball, may have a groove disposed on a great circle extending in the longitudinal direction of the rod. The ball head, at two mutually diametrally oppositely disposed positions, may have a respective cylindrical protrusion, each of the protrusions engaging into an end of the groove in the ball socket. The protrusions can be displaced in the direction of the groove and pivoted about their protrusion axis. Such a claw-like connection between the end of the first rod and the end which bears thereagainst of the second rod permits the transmission of sufficiently high rotary forces. In an embodiment of that kind, the drilling bit must also be non-rotatably connected to the foremost end face of the percussion string. The rear end of the percussion string in that case must be non-rotatably connected to the rotary drive so that rotary forces can be transmitted from the drive unit outside the borehole to the drilling head. The frictional loss can also be considerably reduced by virtue of transmission of the rotary forces by way of the inner percussion string. The rotary forces do not have to be transmitted against the friction within the entire borehole, but only against the frictional forces operative between the outer pipe and the percussion string.

The above-described claw-like connection between the rod ends only represents an example. Any other connections involving a positively locking relationship which permit pivotal movement of the individual rods of the percussion string relative to each other are possible. In that respect, it is to be noted that a motion play of a few degrees between the two end faces of the rods may be sufficient to permit the required inclined positioning between two rods. By virtue of the limited flexibility of the outer pipe, in general very large radii for the borehole axis are achieved, so that the individual rods are each inclined relative to each other only by a few degrees.

Preferably the ends of two rods which bear against each other have guide elements which guide the protrusion for the transmission of rotary force into the recess, when the rod ends bear and press axially against each other. That ensures that for example when fitting a new outer pipe and a new inner rod to the drill string, the non-rotatable connection between the individual rods of the drill string is achieved without involving special adjustment by the operators. Even if the rods of the inner string come loose from each other when inserting a new section of the drill string, the non-rotatable connection between the individual rods is restored automatically by virtue of the action of the guide elements, when the drill string is subsequently fixedly connected to the drive unit.

In this embodiment the rotary drive has to be connected to the percussion string. In order not to apply percussion forces to the rotary drive or the transmission assembly of the rotary drive, a percussion rod should be held axially movably but non-rotatably in the rotary drive. For that purpose a drive pinion may have an internal tooth configuration which co-operates with an axially extending external tooth configuration on the percussion rod and which ensures freedom of axial movement with a positively locking connection in the peripheral direction.

A seal is preferably arranged between the shank of the drilling bit and the outer pipe to prevent uncontrolled discharge of the flushing liquid. The shank of the drilling bit also has an axially extending duct through which the flushing liquid or the flushing medium is passed from the annular space between the percussion string and the outer pipe to the drilling head.

In order to fix the drilling bit within the end section of the outer pipe, the outer pipe, near the drilling head, has a radial reduction in inside diameter, while arranged on the shank of the drilling bit is an enlargement in diameter, which is greater than the reduction in the inside diameter of the outer pipe. In that way the drilling bit is secured by the radial diametral enlargement to prevent it from falling out of the end section of the outer pipe. In a practical embodiment the entrainment profile of the outer pipe in the form of an internal spline or tooth configuration is screwed fast to the end of the outer pipe. That screw connection preferably fixes a divided holding ring which can be fitted into the outer pipe and which forms the reduction in the inside diameter of the outer pipe. Also mounted on the shank of the drilling bit is an annular body which forms the enlargement in the diameter thereof. The element with the spline configuration, which is screwed to the end of the front section of the outer pipe, preferably also carries a sensor or signal generator, by means of which it is possible to ascertain the position of the drilling head by way of a measuring device outside the borehole so that the drilling drive can be controlled to achieve the desired drilling configuration.

Preferably all sections of the outer pipe are connected together by screw sleeves. The screw sleeves may be of a diameter which is enlarged with respect to the diameter of the sections of the outer pipe, for receiving the ball head.

The percussion drive for the percussion string strikes against the rod of the percussion string, which is rearmost in the direction of advance movement. It is generally flange-mounted behind the rotary drive, in which case it acts on a percussion rod which protrudes through the rotary drive and which is axially displaceable with respect to the rotary drive so that the percussion forces applied thereto are not transmitted to the rotary drive but to the percussion string.

The feed for the flushing liquid is preferably arranged near the front end of the percussion rod at a screw connection between the rotary drive and the rearmost section of the outer pipe and is formed by a radial duct which acts through the outer pipe into the annular space between the outer pipe and the percussion string. Preferably, arranged between the outer pipe and the front section of the percussion rod is a seal set which seals off the annular space between the outer pipe and the percussion rod. That ensures that the flushing medium is conveyed exclusively through the annular space between the outer pipe and the percussion string forwardly to the drilling head and not rearwardly in the direction of the drive for the drill string.

In a further preferred embodiment the percussion string can be arrested selectively in the axial direction with respect to the outer pipe. The arresting effect operates at least in the forward feed direction in which the percussion forces also act. The arresting means provide that the percussion forces are transmitted from the piston by way of the percussion string to the outer pipe. As long as the percussion forces are to be used to drive the drilling bit forwardly as rapidly as possible, the outer pipe is to be uncoupled from the percussion string so that the percussion forces act exclusively on the drilling bit and are transmitted thereby to the bottom of the borehole. If however there is a wish to apply hammer blows to the outer pipe by way of the percussion mechanism, for example in order to overcome high frictional forces in the borehole, the outer pipe can be coupled to the percussion string. The percussion forces can also be temporarily applied to the outer pipe which comprises a plurality of pipe sections screwed together, in order to release the screw connections between the pipe sections. The coupling, that is to say the connection which is fixed in the axial direction, must be ensured at least in the direction in which the percussion forces act.

Preferably, the coupling between the outer pipe and the percussion string is effected in the region of the drilling bit at the front end of the drill string. In that way, the drill string is subjected to a pressure loading by the percussion mechanism and transmits its pressure forces at the front end in the region of the drilling bit to the outer pipe. The latter is pulled by the percussion forces in the forward feed direction or the percussion direction. Preferably, the enlargement in diameter of the drilling bit, which fixes it in the outer pipe, is used to provide for axial coupling. For that purpose, the enlargement in diameter can be adapted to be arrested in the condition of bearing in the axial direction against the reduction in diameter of the outer pipe.

That can be achieved by the outer pipe being mounted to the forward drive machine displaceably in the axial direction and fixably in at least two different axial positions. For example, a part of the outer pipe may have radial pins or protrusions which are guided in a sliding sleeve which is fixed to the forward drive machine. For each radial protrusion the sliding sleeve has a guide groove with an axial portion and two holding portions extending in the peripheral direction at the two ends of the axial portion. The radial protrusions of the outer pipe can be accommodated in the guide groove either in the first holding portion or in the second holding portion. In the first holding portion the front end of the front pipe end section of the outer pipe bears against the rearward contact face of the drilling bit so that the drilling bit is freely held in the outer pipe in the forward direction, that is to say in the percussion and forward feed direction. In contrast, in the second holding portion, the reduction in diameter of the outer pipe bears against the enlargement in diameter of the drilling bit so that the axial percussion forces are transmitted to the outer pipe by way of the drilling bit.

BRIEF DESCRIPTION OF THE DRAWINGS

The invention is described in greater detail hereinafter by means of embodiments with reference to the accompanying drawings in which.

INCORPORATION BY REFERENCE

European Patent Application No. 01 201 167.2 filed on Mar. 12, 2001, whose inventor is Dr. Gunter W. Klemm, is hereby incorporated by reference in its entirety as though fully and completely set forth herein.

European Patent Application No. 00 126 781.4 filed on Dec. 6, 2000, whose inventor is Dr. Gunter W. Klemm, is hereby incorporated by reference in its entirety as though fully and completely set forth herein.

DETAILED DESCRIPTION OF THE INVENTION

Figure 1:
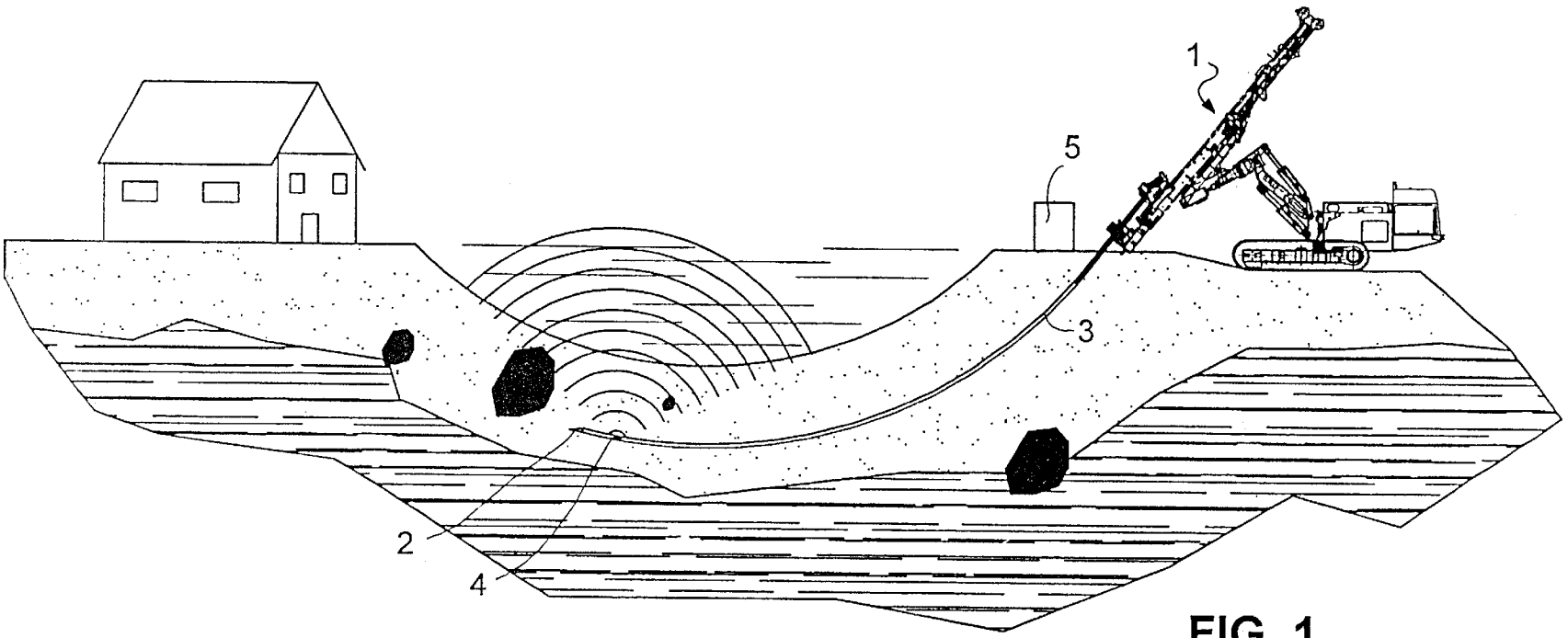
FIG. 1 is a diagrammatic view of an arrangement for carrying out directional drilling.

Referring to FIG. 1, the mode of operation involved in directional drilling can be seen therein. Using a forward drive machine 1, to produce a borehole a drilling head 2 is driven into the ground at an angle by means of a drill string 3. The drill string 3 is carried on a rail-guided sliding carriage of the machine 1 and is driven into the ground by a linear drive. After a forward drive movement by a given distance, a fresh section of the drill string 3 is attached to the drill string 3, the fresh section comprising an outer pipe section 15 and a rod 14 inserted therein of a percussion string 13 (see FIG. 2), and the sliding carriage is withdrawn in order further to advance the drill string 3 which has been increased in length.

Arranged in the proximity of the drilling head 2 is a usually magnetic probe 4 which makes it possible to ascertain the respective precise position of the drilling head 2 by way of a navigation system and a monitor unit. The machine 1 also has a rotary drive with which the drill string 3 can be rotated about its longitudinal axis and arrested in a given angular position. In that way, the plane of the radius of curvature of the borehole produced can be inclined in any directions. The borehole can thus be guided substantially parallel to the surface of the earth in any directions. In particular, as can be seen in FIG. 1, the borehole can be guided with a large radius of curvature from an entry opening into the ground as far as an exit opening so that it is possible to overcome obstacles such as buildings, bodies of water or traffic areas, without an open timbering or lining. If straight borehole sections are to be produced the drilling head 2 is rotated uniformly about its axis.

A pump and mixing unit 5 for a flushing medium, also referred to as drilling mud, which comprises a mixture of bentonite and water, is connected to the drill string 3. The drilling mud is passed into the drill string 3 under high pressure and issues from flushing nozzles in the drilling head 2. That causes material to be removed in the region of the drill head 2. The bentonite in the drilling mud then passes into the annular gap between the drill string and the borehole. That on the one hand supports the borehole which has been formed and on the other hand produces a really low-friction sliding film which reduces the resistance to the forward movement of the drill string 3.

After the pilot bore has been finished, the drilling head 2 which has issued from the exit opening of the borehole is removed from the drill string 3. An enlargement drilling head can then be fixed to the drill string 3, which is again drawn through the pilot bore with the drill string 3.

The substantial proportion of the material removed during the drilling operation is effected by the flushing medium issuing from the flushing nozzles of the drilling head 2. Particularly in the case of relatively hard rock the amount of material removed is increased by hammer or percussion forces applied to the drilling head and possibly continuous rapid rotary movements.

Figure 2:
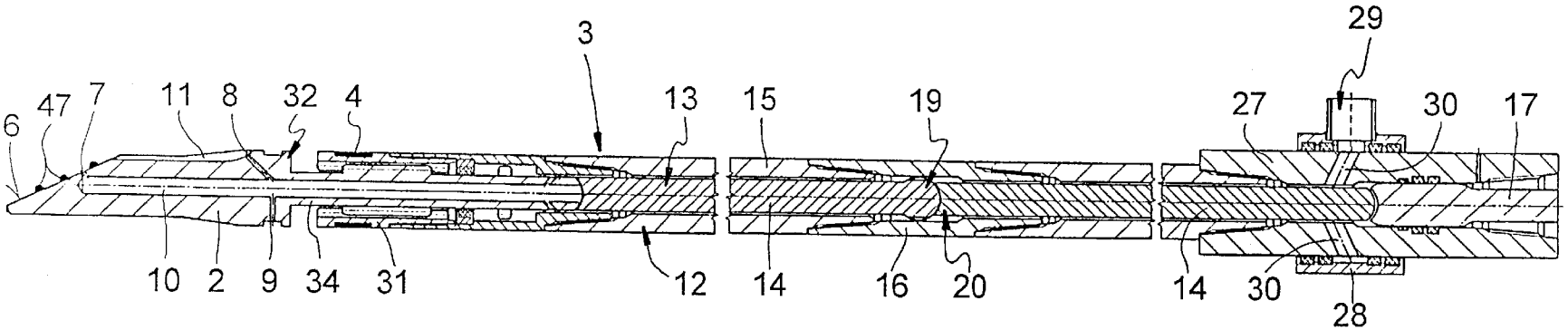
FIG. 2 shows a drill string according to the invention of a directional drilling system.
Figure 3:
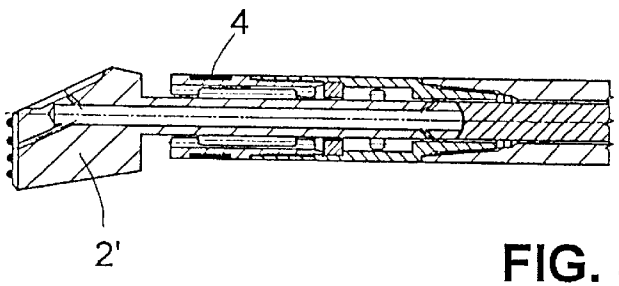
FIG. 3 shows an alternative embodiment of the drilling head of the directional drilling system of FIG. 2.

FIG. 2 shows a drill string according to the invention, which permits the transmission of hammer or percussion forces and rotary movements from the forward feed machine 1 to the drilling head 2. This embodiment includes a directional drilling head which is in the form of a guide shoe. The front end face 6 of the drilling head 2 is inclined with respect to the radial direction of the borehole to be produced. Shown by way of example are three outlet nozzles 7, 8, 9 for the drilling mud which is fed to the drilling head 2 through an axial duct 10. The medium issuing from the outlet nozzle 8 flows along a groove 11 in the end face of the drilling head 2 and is then distributed in the borehole. A plurality of outlet nozzles 9 are distributed at the periphery of the drilling head 2 and one opens at the end face 6 thereof. The end face 6 of the drilling head 2 further has hardened drilling tips 47. The drilling head 2 is deflected along a circular path, as shown in FIG. 1, by virtue of the inclined positioning of the end face 6. When the drilling head 2 is rotated by rotation of the drill string 3, the plane in which the drilling head 2 is deflected is turned.

As can be seen from FIG. 2, the drill string 3 comprises an outer pipe 12 and a percussion string 13. In this case the percussion string 13 comprises individual rods 14 and the outer pipe 12 comprises individual pipe sections 15. The pipe sections 15 are respectively screwed together by way of connecting sleeves 16. The rods 14 of the drill string 13 bear against each other with their end faces without a connection therebetween in the axial direction.

A hammer or percussion rod 17 acts on the rearmost rod 14. Axial hammer blows are applied to the percussion rod 17 by a hydraulically driven piston 18 (see FIG. 4).

As can be seen from FIG. 1, a slight curvature must be applied to the entire drill string 3 in order to follow the curved configuration of the borehole, which is typical of directional drilling. The outer pipe 12 or the pipe sections 15 thereof are of sufficient flexibility to be curved elastically within the borehole. The individual rods 14 of the percussion string 13 in contrast should be substantially rigid in order for the percussion energy to be transmitted to the drilling head 2 with as little delay and as few losses as possible. For that reason, the end faces of the rod ends, which bear against each other, are curved, so that the axes of the rods 14 can be at an angle relative to each other and nonetheless the rod ends bear against each other in surface contact for percussion force transmission purposes.

Figure 5:
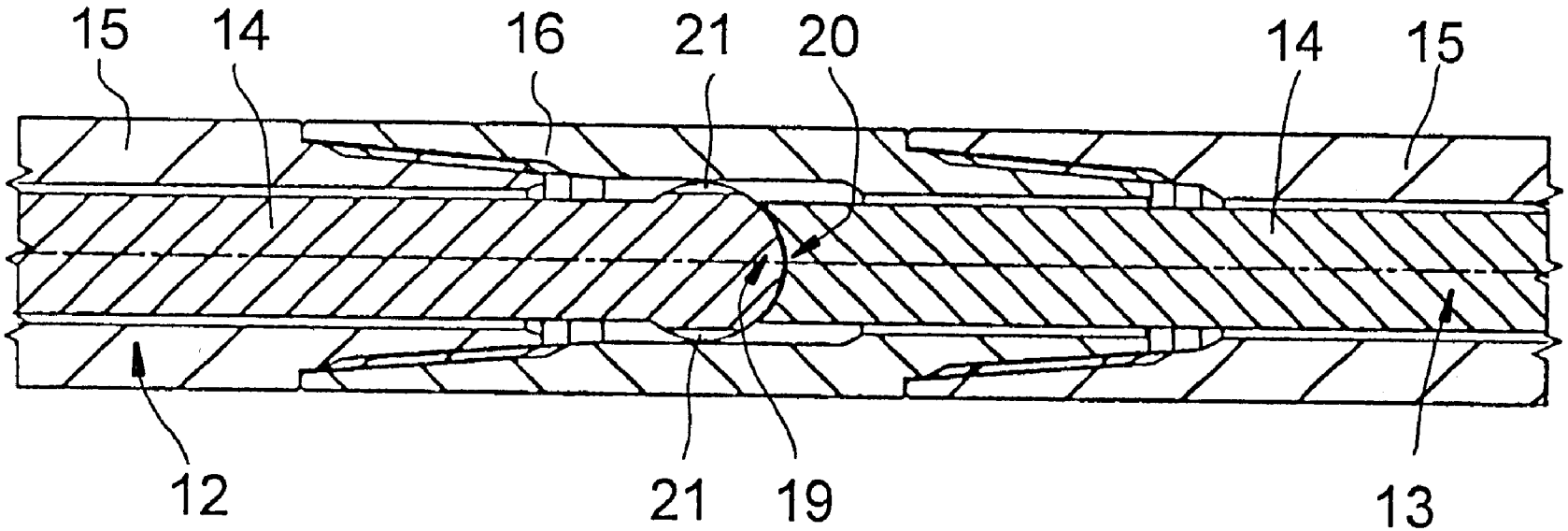
FIG. 5 is a view of a connecting region in which two sections of the drill string are fitted together.

FIG. 5 shows in particular the features of the design configuration of the various rod ends. In this case the rod end 19 which is the rear end in the forward drive direction is of a ball-shaped configuration. The front rod end 20 is of a smaller diameter and is in the shape of a ball socket whose diameter corresponds to the diameter of the spherical rod end 19. It will be readily apparent that, even upon inclined positioning of the longitudinal axes of the two rods 14 which can be seen in FIG. 2, the rod ends 19, 20 are guaranteed to bear against each other in surface contact. That ensures effective transmission of percussion forces from the percussion drive to the drilling head 2. As FIG. 2 shows the diameter of the rear spherical rod end 19 is larger than the diameter in the remaining region of the rod 14. The region of the spherical rod end 19 is also larger than the inside diameter of a pipe section 15. The spherical rod end 19 is inserted into the connecting sleeve 16 which is of a larger inside diameter than the pipe sections 15 connected thereto. In that way the rod end is held in the connecting sleeve 16 displaceably axially over a certain distance without being capable of falling out of the connecting sleeve. It will also be seen from FIG. 5 that the surface of the spherical rod end 19 has radially outwardly disposed recesses 21 which extend in the axial direction and which permit the flushing medium to pass therethrough. The inside diameter of a pipe section 15 is somewhat larger than the outside diameter of a rod 14 so that inclined positioning of the rod 14 through a few degrees is made possible, within the pipe section 15.

As FIG. 1 shows, the curvature of the borehole is of a very large radius so that the drill string rods are inclined only by a few degrees relative to each other and the relatively small gap between the percussion rod 14 and the section 15 of the outer pipe 12 is sufficient to permit the bending of the drill string 3.

Figure 4:
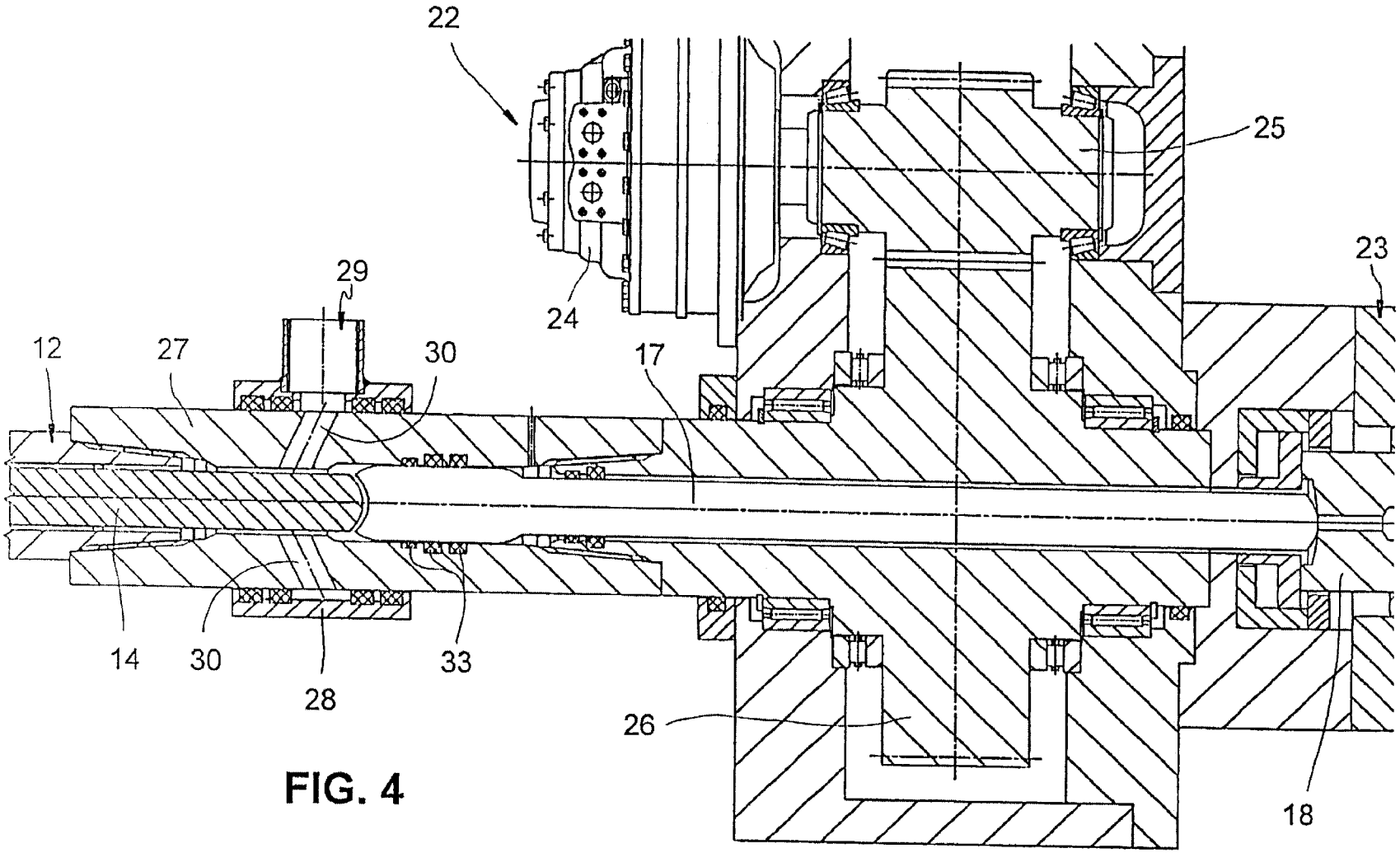
FIG. 4 is a view on an enlarged scale of the drive device of the drilling system according to the invention.

FIG. 4 shows the rotary drive 22 and the hammer or percussion drive 23 which are fixed on the linear guide of the forward drive machine 1 (FIG. 1). The rotary drive 22 comprises a hydraulic motor 24, on the motor shaft of which is fixed a pinion 25 meshing with a gear 26 which is connected non-rotatably to the outer pipe 12 by way of a connection sleeve 27. The connection sleeve 27 is embraced by a sealed collar member 28 into which opens a feed line 29 for a flushing medium. The connection sleeve 27 has two radial feed ducts 30 through which the flushing medium can pass into the interior of the outer pipe 12.

The gear 26 is hollow along its axis and has a percussion rod 17 extending therethrough. The front end face of the percussion rod 17 is in the form of a ball socket and bears against the end face, which is at the rear in the direction of forward feed, of the rearmost rod 14 of the percussion string 13. The percussion rod 17 is sealed with respect to the connection sleeve 27 by means of a plurality of seals 33 in order to prevent flushing liquid from escaping rearwardly. The above-mentioned hydraulically driven piston 18 of the percussion drive 23 acts on the rearward end of the percussion rod 17. FIG. 4 only shows the front end section of each of the piston 18 and the percussion drive 23. Percussion drives of that kind for applying percussion forces to drill strings have long been known to the men skilled in the art.

When the drilling head 2 is driven forward the drill string 3 is moved forwardly by a respective given longitudinal distance by the forward drive machine 1 (see FIG. 1). Then, a unit of the drill string 3 comprising a rod 14 and an outer pipe section 15 is attached, with the sliding carriage of the forward drive machine 1 having been retracted beforehand. In a fresh forward drive step, the sliding carriage of the forward drive machine 1 is displaced forwardly.

Figure 6:
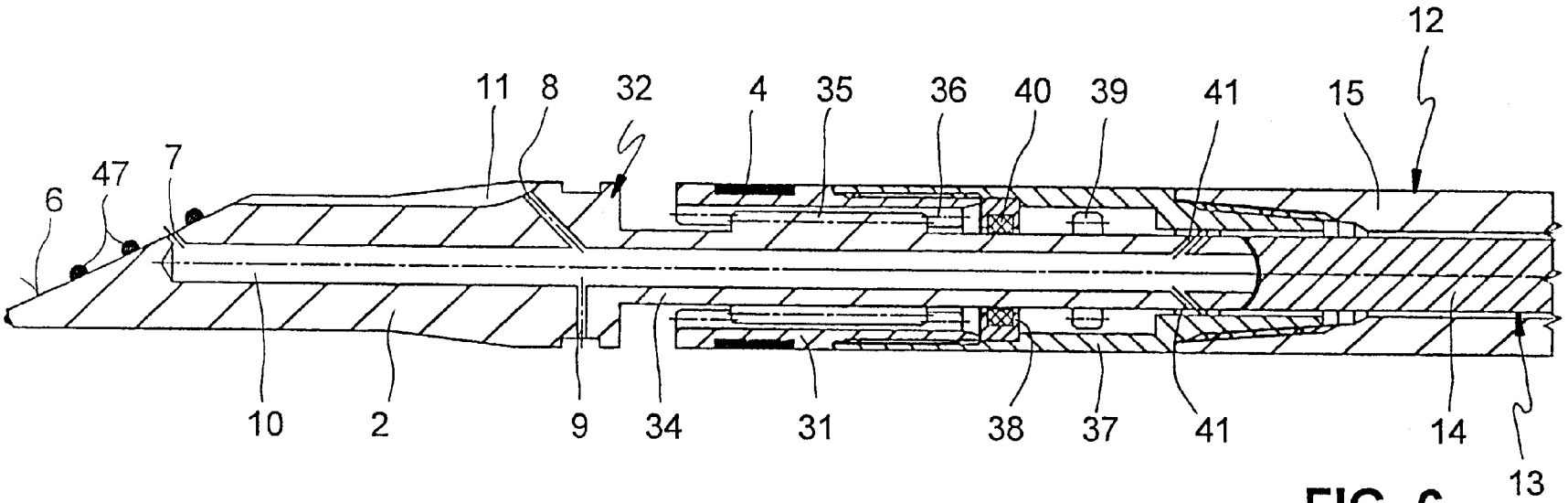
FIG. 6 shows the end section of the drill string with the first embodiment of the drilling head of FIG. 2, FIGS. 7–10 show an alternative embodiment of the directional drilling system according to the invention with a percussion string adapted for the transmission of rotary forces.

Therefore, following the rotary/percussion drive which can be seen in FIG. 4, the drill string 3 shown in FIG. 2 comprises a plurality of drill string sections, in which respect the section of the drill string 3 which is the foremost section in the forward feed direction is connected to an end section 31 of the outer pipe and a drilling bit 32. The end section 31 of the outer pipe 12 and the drilling bit 32 can be particularly clearly seen in FIG. 6. FIG. 6 is a view on an enlarged scale in relation to FIG. 2 showing the drilling head 2 with the inclined end face 6, and the outlet nozzles 7–9 for the flushing medium, which are fed from the axial duct 10. The drilling head 2 which is at the front in the forward drive direction and a shank 31 in the form of a cylindrical rod form the two main components of the drilling bit 32.

The drilling bit 32 is held non-rotatably in the front end section 31 of the outer pipe 12. The shank 34 of the drilling bit 32 has an external tooth configuration 35 meshing with an internal tooth profile 36. In that way the drill shank 34 is held axially displaceably and fixedly in the direction of rotation, in the pipe end section 31. The pipe end section 31 is formed by a sleeve member which bears a male screwthread at the end which is the rear end in the forward drive direction, and is fixedly screwed to a connecting sleeve 37 at the front end of the foremost pipe section 15 of the outer pipe 12. Fixed by way of that screwthread connection is a holding ring 38 which forms a reduction in the diameter of the outer pipe 12 near its end section 31. That holding ring 38 co-operates with an annular shoulder 39 which is carried on the rear end of he shank 34 of the drilling bit 32 and forms and enlargement in the diameter of the shank 34. In that way the drilling bit 32 is prevented from falling out when the drill string 3 is retracted in the opposite direction to the forward drive direction.

Also arranged in the holding ring 38 is a seal 40 which seals off the internal space in the outer pipe 12 with respect to the shank 34 of the drilling bit 32. Arranged at the rear end of the shank 34 of the drilling bit 32 are two inclinedly extending duct portions 41 which open into the annular space between the shank 34 and the outer pipe 12 and which permit flushing medium to pass into the axial duct 10 of the drilling it 2.

Figures 7, 8A, 8B, 8C, 9A, 9B, 9C, 10:
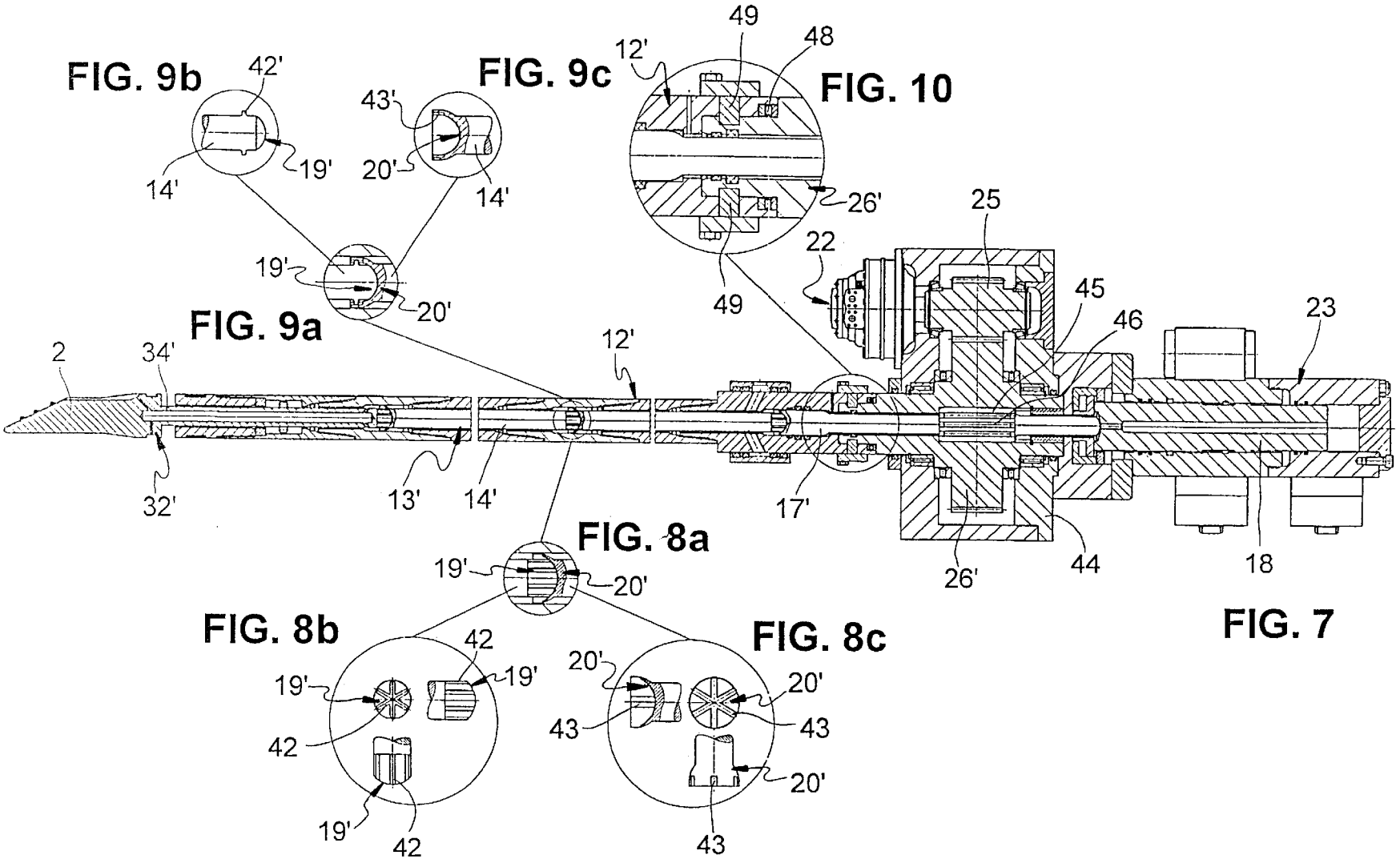

FIG. 7 and the detailed views on an enlarged scale in FIGS. 8*a*–8*c*, 9*a*–9*c* and 10 show an alternative embodiment of the drilling system in which rotary forces are also applied to the drilling head 2 by way of the percussion string 13'.

The views on an enlarged scale showing individual parts in FIGS. 8*a*–8*c* show the two ends 19' and 20' of the rods 14'. In this respect, FIG. 8*a* is a view in longitudinal section showing the rod end 20' which is in the form of a ball socket and into which the rod end 19' which is in the form of a ball head is inserted. FIG. 8*b* shows only the rod end 19' in the form of the ball socket, as a plan view and two side views. FIG. 8*c* shows the rod end 20' in the form of a ball socket, as a plan view, in longitudinal section and as a side view. Each rod 14' of the percussion string 13' includes a rear rod end 19' which is curved in the form of a ball head and on which are arranged projections 42 in the form of a star. The front rod end 20' which is curved in the form of a ball socket has star-shaped grooves 43 for receiving the projections 42 of the rear rod end 19' of the adjoining rod 14'. The oppositely disposed rod ends 19', 20' are fixedly connected together in the direction of rotation by the projections 42 engaging into the grooves 43. Preferably the front rod end 20' is provided with guide surfaces which guide the projections 42 at the rear rod end 19' into the grooves 43 at the front end 20' of the adjoining rod 14' when the ends are pressed against each other. In that way the rod ends 19', 20' do not have to be oriented relative to each other in respect of direction of rotation, in the assembly procedure.

No trouble is caused if the projections 42 and the grooves 43 limit the free pivotability of the ball joint which is formed by the rod ends 19', 20'. As already mentioned, the angle involved in the inclined positioning of two mutually adjoining rods relative to each other is very slight. Thus, a certain clearance between the projections 42 and the grooves 43 is sufficient to permit adequate pivotability of mutually adjoining rods 14' about the parallel position.

In an alternative representation of the individual parts shown on an enlarged scale in FIGS. 9*a*–9*c* in respect of the rod ends 19' and 20' for transmission of the rotary force, FIG. 9*a* shows the interengaged rod ends 19' and 20', FIG. 9*b* shows a side view of the rod end 19' in the form of a ball head and FIG. 9*c* shows a view in longitudinal section of the rod end 20' in the form of a ball socket. Here, the projections 42' are in the form of radially extending, mutually diametrally opposite pins or protrusions. The grooves 43' in the rod end 20' in the form of the ball socket are also disposed in diametrally opposite relationship and receive the protrusions 42'. The embodiment illustrated here for the non-rotatable. connection permits a greater angle of pivotal movement of the ball head 19' with respect to the ball socket 20'.

By virtue of the rotary movement being transmitted by means of the percussion string 13', the drive force of the rotary drive 22 is no longer reduced by friction of the outer pipe 22 against the wall of the borehole.

It will be appreciated that other structural systems of the drilling system are also altered because of the transmission of rotary force by means of the percussion string 13'. Thus, the drilling bit 34' which has the drilling head 2 is held freely rotatably in the front end of the outer pipe 12'. To apply the rotary force to the percussion string 13', the hollow gear 26' is mounted rotatably in the housing 44 of the rotary drive 22 and is not connected to the outer pipe 12' in the direction of rotation. The hollow gear 26' has an inner tooth or spline profile 45 which co-operates with an external tooth or spline configuration 46 on the percussion rod 17'. Thus, the rotary force of the rotary drive 22 is transmitted to the percussion rod 17' by way of the inner tooth or spline profile 45 and the external tooth or spline configuration 46, in which case the percussion rod 17' is axially displaceable with respect to the gear 26' so that the percussion or hammer forces transmitted by the piston 18 of the percussion drive 23 on to the rear end of the percussion rod 17' are not transmitted to the gear 26' but only to the percussion rod 13'. All end faces which bear against each other, in the form of a ball and a ball socket, have the projections 42, 42' and grooves 43, 43' for making the connection which is fixed in the direction of rotation, so that the rotary drive 22 is non-rotatably connected to the drilling head.

If the inner percussion string 13' is non-rotatably connected to the gear 26' of the rotary drive, it will be appreciated that the non-rotatable coupling of the outer string 12' to that gear 26' can be omitted. The detail view in FIG. 10 shows that the outer pipe 12' is uncoupled in the direction of rotation with respect to the gear 26' by a rolling bearing 48. In this case positively locking connecting bodies 49 can be releasably arranged in the region of the connection between the outer pipe 12' and the gear 26'. When those connecting bodies 49 are inserted the rotary drive acts both on the percussion string 13' and also on the outer pipe 12'. If the positively locking connecting bodies 49' are removed, then only the inner percussion string 13' is rotated.

Figures 11, 11A, 11B:
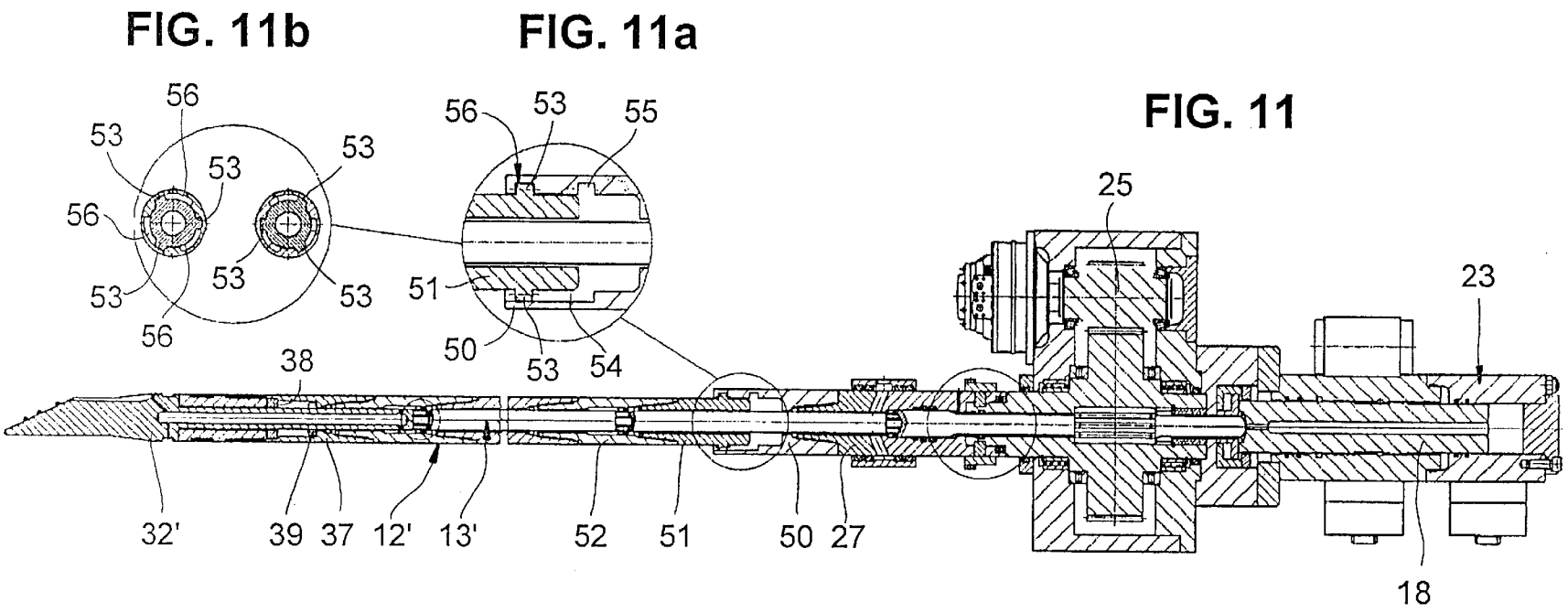
FIGS. 11 and 12 show an embodiment corresponding to FIGS. 7–10 of the directional drilling system according to the invention with percussion force transmission from the percussion string to the outer pipe.
Figures 12, 12A, 12B:
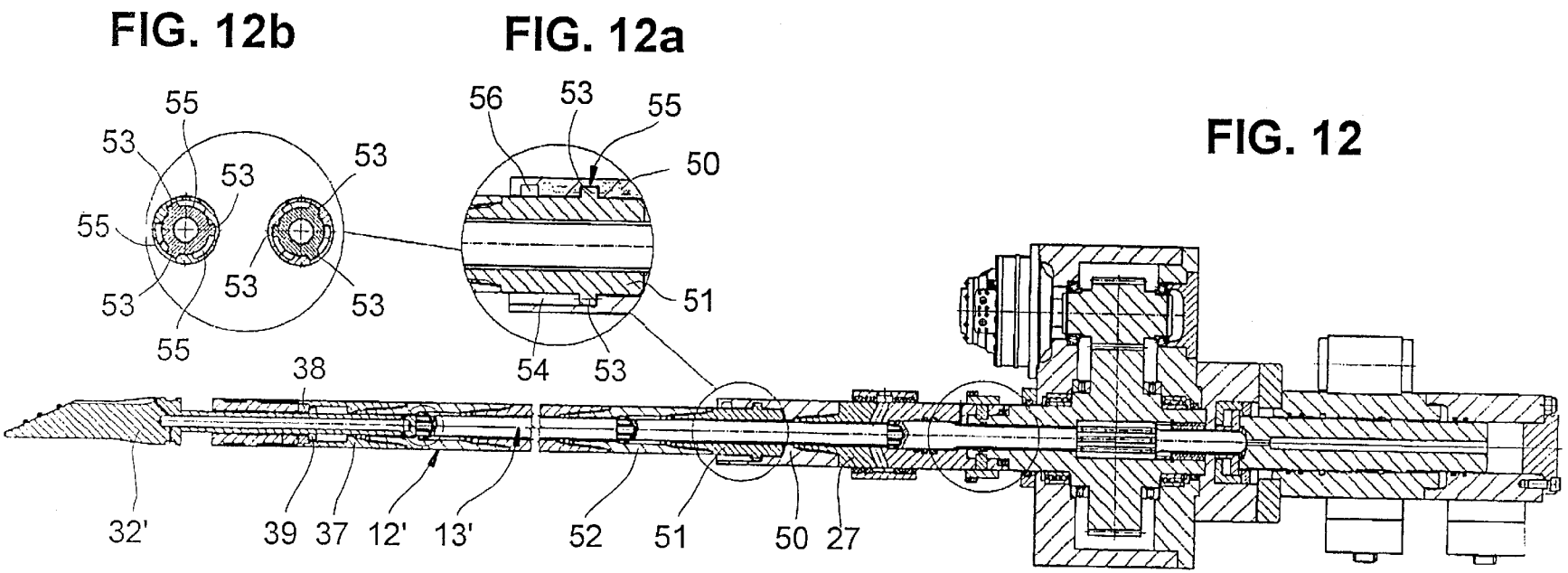

FIG. 11 with the detail views in FIGS. 11*a* and 11*b* and FIG. 12 with the detail views of FIGS. 12*a* and 12*b* show an embodiment in which the percussion energy can be transmitted on the one hand to the drilling bit 32' alone and on the other hand to the drilling bit 32' and the outer pipe 12'. For that purpose the outer pipe 12' is connected to the forward drive machine by way of a sliding sleeve member 50. The sleeve member 50 is arranged in front of the connecting sleeve member 27 in the direction of advance movement and co-operates with a coupling portion 51 which is screwed to a reduced-length rear pipe section 52 of the outer pipe 12'.

The coupling portion 51 has at uniform spacings at three peripheral positions respective protrusions 53 which are accommodated in a guide groove in the thrust member 50. Each of the three guide grooves includes an axial portion 54 which goes into two holding portions 55, 56 which extend in the peripheral direction. The protrusion-groove connection between the coupling portion 51 and the sleeve member 50 acts like a bayonet fastening. In the first rotational position of the coupling portion 51, which is shown at the left in FIGS. 11*b* and 12*b*, the protrusions 53 can be displaced in the axial portion 54 of the guide groove. In the second rotational position of the coupling portion 51, which is shown at the right in FIGS. 11*b* and 12*b*, the protrusions 53 can be received in the peripherally extending holding portions 55, 56 of the guide grooves. The two rotational positions are illustrated in FIGS. 11*a* and 12*a* on the one hand above the centre line (protrusion 53 received in the holding portion 55 or 56) and on the other hand below the centre line (protrusion displaceable in the axial portion 54 of the guide groove).

When the protrusions 53 are disposed in the front holding portion 56, as shown in FIGS. 11 and 11*a*, the outer pipe 21' is pushed relative to the percussion string 13' and the drilling bit 32' into the front position. The drilling bit 32' is pushed substantially into the outer pipe 12' and can be driven axially out of the outer pipe 12' by the percussion string 13'. It is to be noted that the annular collar member 39 which forms the enlargement in the diameter of the drilling bit 32' has adequate motion clearance as far as the holding ring 38 in the connecting sleeve 37 in the advance or percussion direction.

When in contrast the protrusions 53 are disposed in the rear holding portion 55, as shown in FIGS. 12 and 12*a*, the outer pipe 12' is pushed into the rear position relative to the percussion string 13' and the drilling bit 32'. The drilling bit 32' is pushed substantially out of the outer pipe 12'. In this case, the annular collar member 39 which forms the enlargement in the diameter of the drilling bit 32' bears axially against the holding ring 38 in the connecting sleeve 37 so that the hammer blows which are transmitted by the percussion string 13' to the drilling bit 32' are passed by the drilling bit 32' to the outer pipe 12'. In that way, in the drilling operation, starting from the bottom of the drill hole, percussion forces can be applied to the outer pipe 12', which forces for example pull the string further into the borehole with a high level of friction at the outside of the string. Before dismantling of the arrangement the hammer blows which are transmitted to the outer pipe 12' can loosen the connecting screwthreads between the individual pipe sections 15 of the outer pipe 12'.

List of References

1 forward drive machine
2,2' drilling head
3 drill string
4 magnetic probe
5 pump and mixing device/conveyor device
6 end face
9 outlet nozzle
8 outlet nozzle
9 outlet nozzle
10 duct
11 groove
12,12' outer pipe
13,13' percussion string
14,14' rod
15 pipe section
16 connecting sleeve
17,17' percussion rod
18 piston
19,19' rear rod end, rear end face, ball head
20,20' front rod end, front end face, ball socket
21 recess
22 rotary drive
23 percussion drive
24 hydraulic motor
25 pinion
26,26' gear
27 connecting sleeve member
28 collar member
29 feed line
30 feed duct,
31 pipe end section
32,32' drilling bit
33 seal
34,34' shank
35 external tooth configuration
36 internal tooth profile
37 connecting sleeve member
38 holding ring, reduction in diameter
39 annular collar member, enlargement in diameter
40 seal
41 inclined duct portions
42,42' projection
43,43' groove
44 housing
45 tooth profile
46 external tooth configuration
47 drilling tip
48 rolling bearing
49 connecting element
50 sliding sleeve member
51 coupling portion
52 reduced-length pipe section
53 protrusion
54 axial portion of the guide groove
55 front holding portion of the guide groove
56 rear holding portion of the guide groove

I claim:

1. A drilling system having a drilling head (2, 2') fixed to a drill string (3) which comprises an outer pipe (12, 12') and a percussion string (13, 13') inserted therein, wherein the percussion string (13, 13') comprises a plurality of rods (14, 14') which bear against each other with their end faces (19, 20; 19', 20'), characterised in that the outer pipe (12, 12') is adapted to be deformable along its longitudinal axis and the end faces (19, 20; 19', 20') which bear against each other of two of said plurality of rods (14, 14') are so designed that they bear against each other substantially in surface contact upon inclined positioning of the axes of the two of said plurality of rods (14, 14') relative to each other.

2. A system according to claim 1 characterised in that each rod (14, 14') is supported only in one or two short regions of the length thereof in relation to the inside wall of the outer pipe (12, 12').

3. A system according to claim 2 characterised in that ducts or recesses (21) extending in the axial direction for a flushing medium to pass therethrough are provided in the region in which each rod (14, 14') is supported against the inner wall of the outer pipe (12, 12').

4. A system according to claim 1 characterised in that the end faces (19, 20; 19', 20') which bear against each other of two of said plurality of rods (14, 14') are curved on the one hand convexly and on the other hand concavely.

5. A system according to claim 4 characterised in that one end (19, 19') of each rod is formed by a ball head and the other end (20, 20') of each rod is formed by a ball socket.

6. A system according to claim 5 characterised in that the diameter of the ball head (19, 19') substantially corresponds to the inside diameter of the outer pipe (12, 12').

7. A system according to claim 5 characterised in that the diameter of the section of each rod (14, 14'), which adjoins the ball head (19, 19'), is smaller than the diameter of the ball head (19, 19').

8. A system according to claim 5 characterised in that, in its region which is disposed outwardly in the radial direction of the rod, the ball head (19, 19') has recesses (21) which extend in the axial direction of the rod (14, 14').

9. A system according to claim 1 characterised in that the rod (14, 14') which is the foremost rod in the direction of advance movement of the drill string (3) bears with an end face (20, 20') against an end face of a drilling bit (32, 32') which carries the drilling head (2, 2').

10. A system according to claim 9 characterised in that the drilling bit (32) is held axially movably and non-rotatably in the outer pipe (12).

11. A system according to claim 10 characterised in that the drilling bit (32) has a shank (34) with an external spline configuration (35) which is axially slidably guided in an internal spline profile (36) of the outer pipe (12).

12. A system according to claim 10 characterised in that a rotary drive (22) is connected to the outer pipe (12), the rotary drive preferably being actuated hydraulically.

13. A system according to claim 9 characterised in that a seal (40) is arranged between the shank (34) of the drilling bit (32) and the outer pipe (12).

14. A system according to claim 13 characterised in that at least one duct (41) for conducting a flushing medium opens in the region of the shank (34), which is in front of the seal (40) within the outer pipe (12).

15. A system according to claim 9 characterised in that a reduction (38) in the inside diameter is arranged in the outer pipe (12) near the drilling head (2) and that an enlargement in diameter (39) is arranged at the region of the shank (34) of the drilling bit (32), which is in front of the reduction (38) within the outer pipe, which enlargement in diameter (39) is larger than the reduction (38) in the inside diameter of the outer pipe (12).

16. A system according to claim 1 characterised in that the ends (19', 20') of two rods (14') which bear against each other have connecting elements (42, 43, 42', 43') which engage into each other in positively locking relationship, for the transmission of rotary forces.

17. A system according to claim 16 characterised in that the connecting elements comprise on the one hand at least one recess (43, 43') in one (20') of the end faces (19', 20'), which bear against each other, of the rods (14') and on the other hand at least one projection (42, 42') at the end face (20') of the other rod (14').

18. A system according to claim 17 characterised in that the ends (19', 20') of two rods which bear against each other include guide elements which, when the rod ends (19', 20') are axially pressed against each other guide the projection (42, 42') into the recess (43, 43').

19. A system according to claim 16 characterised in that a rotary drive (22) is connected to the percussion string (13'), which rotary drive is preferably actuated hydraulically.

20. A system according to claim 1 characterised in that the outer pipe (12) comprises pipe sections (15) which are connected together by way of screwable connecting sleeves (16).

21. A system according to claim 1 characterised in that it includes a preferably hydraulically actuated percussion drive whose piston (18) acts on the rod (14, 14') of the percussion string (13, 13'), which is the rearmost rod in the direction of advance movement of the drill string.

22. A system according to claim 1 characterised in that at least one feed duct (30) which passes through the outer pipe (12) for a flushing medium is arranged near the end of the drill string (3), which is the rear end in the direction of advance movement.

23. A system according to claim 22 characterised in that the annular space between the outer pipe (12) and the percussion string (13) is sealed off at the rear end of the drill string (3).

24. A system according to claim 1 characterised in that a reduction (38) in the inside diameter is arranged in the outer pipe (12) near the drilling head (2) and that an enlargement in diameter (39) is arranged at the region of the shank (34) of the drilling bit (32), which is in front of the reduction (38) within the outer pipe, which enlargement in diameter (39) is larger than the reduction (38) in the inside diameter of the outer pipe (12), the percussion string (13') can be fixed in the axial direction with respect to the outer pipe (12') at least in the direction of advance movement.

25. A system according to claim 24 characterised in that the outer pipe (12') is displaceable on the forward drive machine (1) in the axial direction and can be fixably secured in at least two different axial positions.

26. A system according to claim 1 characterised in that:

a reduction (38) in the inside diameter is arranged in the outer pipe (12) near the drilling head (2) and that an enlargement in diameter (39) is arranged at the region of the shank (34) of the drilling bit (32), which is in front of the reduction (38) within the outer pipe, which enlargement in diameter (39) is larger than the reduction (38) in the inside diameter of the outer pipe (12);

the percussion string (13') can be fixed in the axial direction with respect to the outer pipe (12') at least in the direction of advance movement; and the enlargement (39) in the diameter of the drilling bit (32) can be arrested with respect to the outer pipe (12'), wherein it bears in the axial direction against the reduction (38) in diameter of the outer pipe (12').

* * * * *